US006971285B2

(12) United States Patent
Chen

(10) Patent No.: US 6,971,285 B2
(45) Date of Patent: Dec. 6, 2005

(54) SELECTIVE ONE-WAY WRENCH

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 17 days.

(21) Appl. No.: 10/733,382

(22) Filed: Dec. 12, 2003

(65) Prior Publication Data

US 2005/0092136 A1 May 5, 2005

(30) Foreign Application Priority Data

Oct. 29, 2003 (TW) ..... 92130014 A

(51) Int. Cl.[7] ..... B25B 13/46
(52) U.S. Cl. ..... 81/63.1; 81/177.85
(58) Field of Search ..... 81/61, 62, 63.1, 81/177.85; 192/43.1

(56) References Cited

U.S. PATENT DOCUMENTS 4,420,995 A * 12/1983 Roberts ..... 81/60

* cited by examiner

*Primary Examiner*—Debra S Meislin
(74) *Attorney, Agent, or Firm*—Charles E. Baxley

(57) ABSTRACT

In a selective one-way wrench, a handle projects from an annular head. The annular head defines a first space and a second space communicated with the first space. A gear is rotationally put in the first space and includes a toothed external face. A direction controller is put in the second space and includes two pawls and a spring installed between the pawls each including a rod formed thereon and a toothed face. A driver is put rotationally in the second space and includes two fingers selective one of which contacts the rod of selective one of the pawls so as to bring the toothed face of the selected pawl into engagement with the toothed external face of the gear. A direction switch is installed rotationally on the annular head and operably connected with the driver.

2 Claims, 7 Drawing Sheets

SELECTIVE ONE-WAY WRENCH

This Non-provisional application claims priority under 35 U.S.C. § 119(a) on Patent Application No(s). 92130014 filed in Taiwan on Oct. 29, 2003, the entire contents of which are hereby incorporated by reference.

FIELD OF INVENTION

The present invention relates to a selective one-way wrench.

BACKGROUND OF INVENTION

Referring to FIG. 8, a conventional selective one-way wrench 80 includes a handle 92, an annular head 81, an annular gear 86, a direction controller 87 and a direction switch 90. An annular head 81 is formed at an end of the handle 92. The annular head 81 defines a first space 82, a second space 83 communicated with the first space 82, a third space 89 communicated with the second space 83 and a recess 84 communicated with the third space 89. The annular gear 86 is rotationally put in the first space 82. The annular gear 86 includes a toothed external face 99 formed thereon. The direction controller 87 is put in the second space 83. The direction controller 87 includes two pawls 94 and 95 and a spring 88 installed between the pawls 94 and 95. The pawl 94 includes a toothed face 96 formed thereon. The pawl 95 includes a toothed face 97 formed thereon. The direction switch 90 is rotationally installed in the recess 84 of the handle 92 and partially put in the third space 89 for bringing the toothed face 96 of the pawls 94 or the toothed face 97 of the pawl 95 into engagement with the toothed external face 99 of the annular gear 86.

SUMMARY OF INVENTION

The primary objective of the present invention is to provide a selective one-way wrench.

In a selective one-way wrench, a handle projects from an annular head. The annular head defines a first space and a second space communicated with the first space. A gear is rotationally put in the first space and includes a toothed external face. A direction controller is put in the second space and includes two pawls and a spring installed between the pawls each including a rod formed thereon and a toothed face. A driver is put rotationally in the second space and includes two fingers selective one of which contacts the rod of selective one of the pawls so as to bring the toothed face of the selected pawl into engagement with the toothed external face of the gear. A direction switch is installed rotationally on the annular head and operably connected with the driver.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings.

DETAILED DESCRIPTION OF EMBODIMENTS

Figure 1:
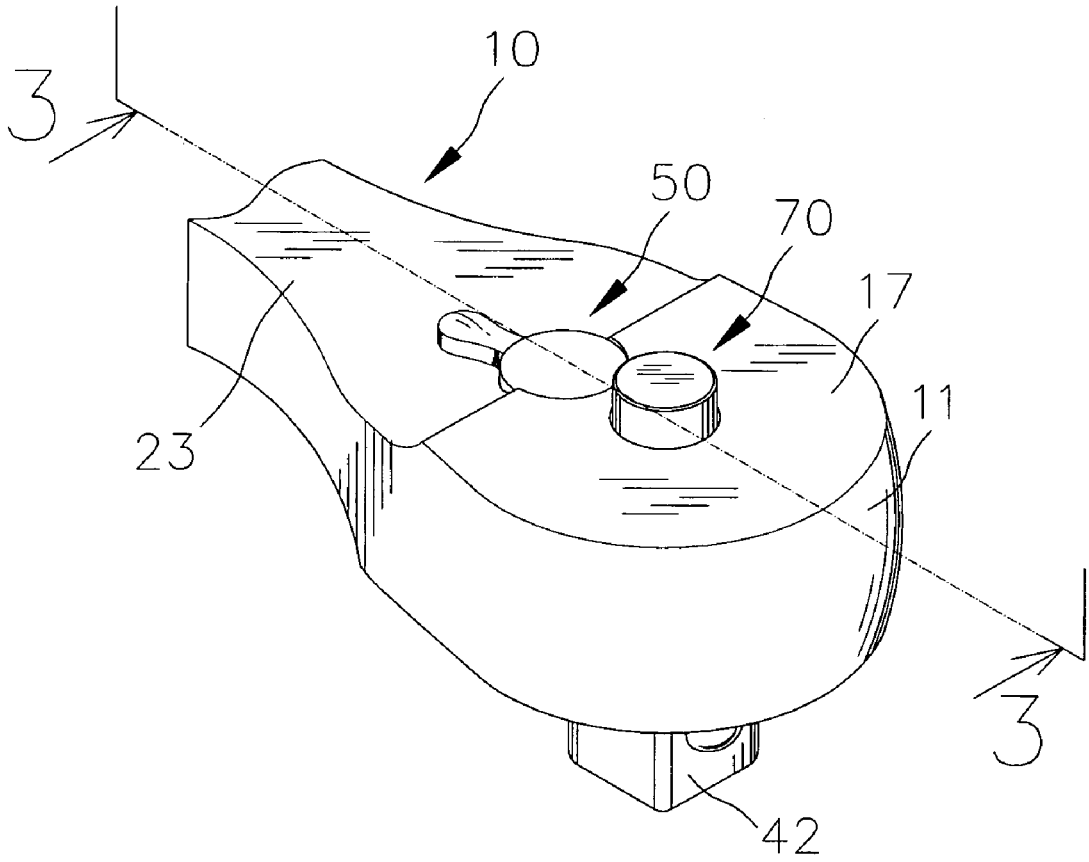
FIG. 1 is a perspective view of a selective one-way wrench according to a first embodiment of the present invention.

Referring to FIG. 1, according to a first embodiment of the present invention, a selective one-way wrench 10 includes a handle 23 and an annular head 11 from which the handle 23 projects.

Figure 2:
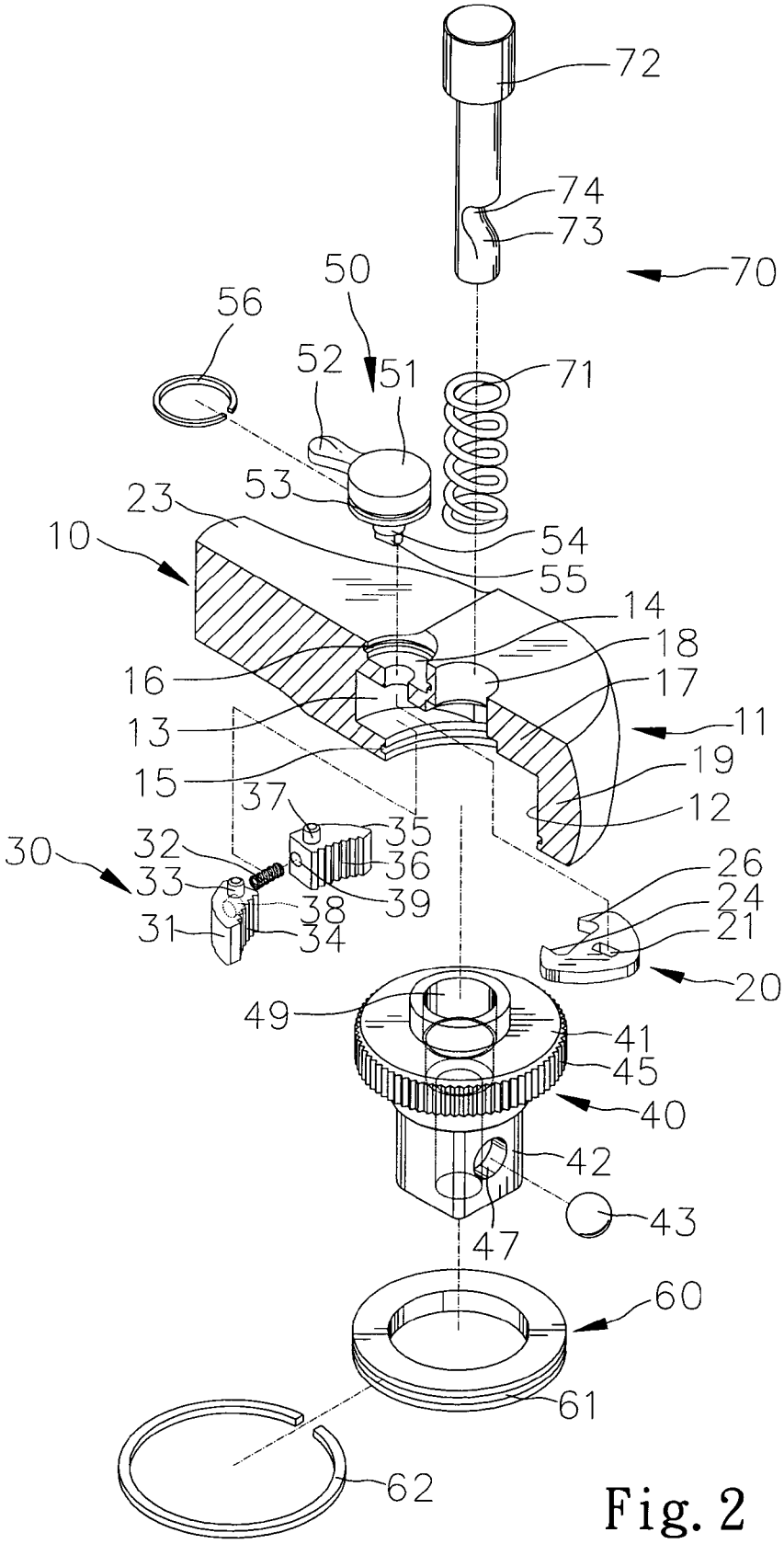
FIG. 2 is an exploded view of the selective one-way wrench shown in FIG. 1.

Referring to FIG. 2, the annular head 11 includes a lower portion 19 and an upper portion 17. The annular head 11 includes a circular space 12 defined in the lower portion 19 and a crescent space 13 defined in the lower portion 19 and communicated with the circular space 12. An annular groove 15 is defined in the wall of the circular space 12. The upper portion 17 of the annular head 11 defines an aperture 18 communicated with the circular space 12 and a countersink hole 14 communicated with the crescent space 13. An annular groove 16 is defined in a wall of the countersink hole 14.

A direction controller 30 is put in the crescent space 13. The direction controller 30 includes two pawls 31 and 35 and a spring 32 for connecting the pawl 31 with the pawl 35.

The pawl 31 includes a top, a bottom, a planar side, a toothed side 34, an arched side, a hole 38 defined in the planar side and a rod 33 formed on the top.

The pawl 35 includes a top, a bottom, a planar side, a toothed side 36, an arched side, a hole 39 defined in the planar side and a rod 37 formed on the top.

The spring 32 includes an end fit in the hole 38 and opposite end fit in the hole 39. Thus, the pawl 31 is firmly connected with the pawl 35 by means of the spring 32.

The driver 20 is put in the crescent space 13. The driver 20 includes a recess 21 defined therein and two fingers 24 and 26 both extending from a side.

The direction switch 50 is put in the countersink hole 14. The direction switch 50 includes a disc 51 and a lever 52 extending from the disc 51. An annular groove 53 is in the periphery of the disc 51. The direction switch 50 further includes a shaft 54 extending from the disc 51 and a ridge 55 extending from the shaft 54.

A C-ring 56 includes an internal edge put in the annular groove 53. The ridge 55 is inserted into the recess 21 through the countersink hole 14. The direction switch 50 can drive the driver 20 so that the finger 24 or 26 is engaged with the rod 33 or 37. The C-ring 56 includes an external edge put in the annular groove 16. Thus, the direction switch 50 is firmly attached to the annular head 11 by means of the C-ring 56.

The joint 40 is put in the circular space 12. The joint 40 includes a disc 41 and a square insert 42 extending from the disc 41. The disc 41 includes a toothed periphery 45. The square insert 42 is used for insertion into a square hole defined in a socket (not shown). The square insert 42 includes a hole 47 defined therein. The joint 40 includes a space 49 defined in both of the disc 41 and the square insert 42 and a hole 47 defined in the square insert 42 and communicated with the space 49. The space 49 includes an upper section and a narrow lower section, thus forming an annual shoulder 78 (shown in FIG. 3) between the sections thereof.

An O-ring 60 is put in the circular space 12. The O-ring 60 includes an annular groove 61 defined in an external face thereof.

A C-ring 62 includes an internal edge put in the annular groove 61 and an external edge put in the annular groove 15. Thus, the O-ring 60 is firmly attached to the annular head 11 by means of the C-ring 62. The joint 40 is put in the O-ring 60 rotationally.

The control device 70 includes a rod 72 and a spring 71. The spring 71 is put in the space 49. The rod includes a hole 74 defined therein and an inclined face 73 extending from the rod 72. The rod 72 includes an upper section and a narrow lower section, thus forming an annual shoulder 76 (shown in FIG. 3) between the sections thereof. The rod 72 is inserted into the space 49. The spring 71 is compressed between the annular shoulders 76 and 78. Thus, the rod 72 is biased upward by means of the spring 71. A portion of a ball detent 43 is trapped in the hole 47. The remaining portion of the ball detent 43 is caused to extend from the hole 74 by means of the inclined face 73 of the rod 72. Therefore, the ball detent 43 can retain the socket to the square insert 45.

When a user pushes down the rod 72, the ball detent 43 is inserted into the hole 74, i.e., the ball detent 43 is completely concealed in the hole 74. Thus, the square insert 42 can be inserted into a square hole defined in a socket.

Figure 4:
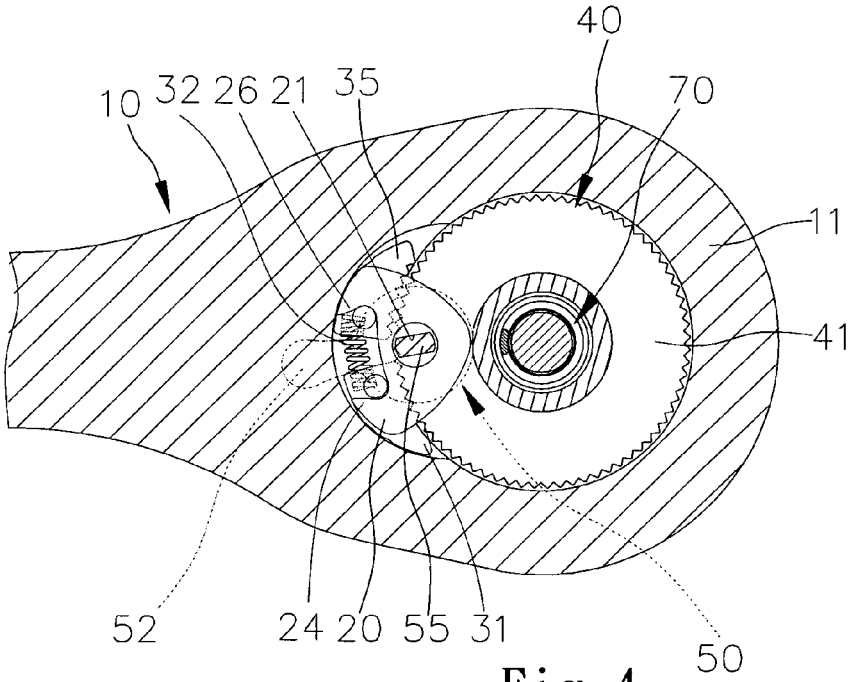
FIG. 4 is a cross-sectional view taken along a line 4—4 of FIG. 3.
Figure 3:
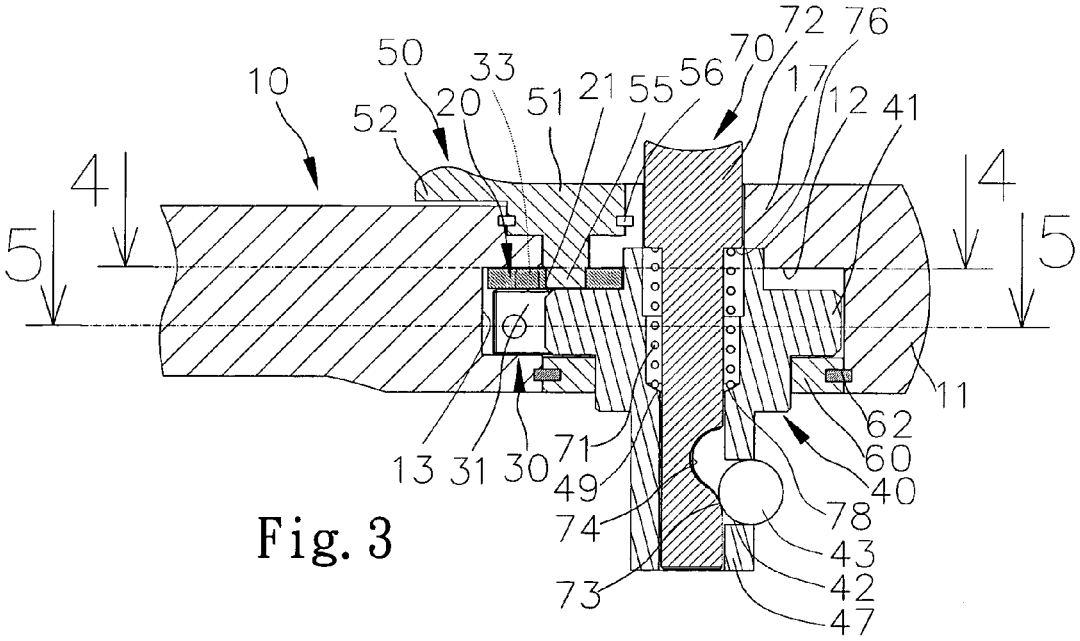
FIG. 3 is a cross-sectional view taken along a line 3—3 of FIG. 1.
Figure 5:
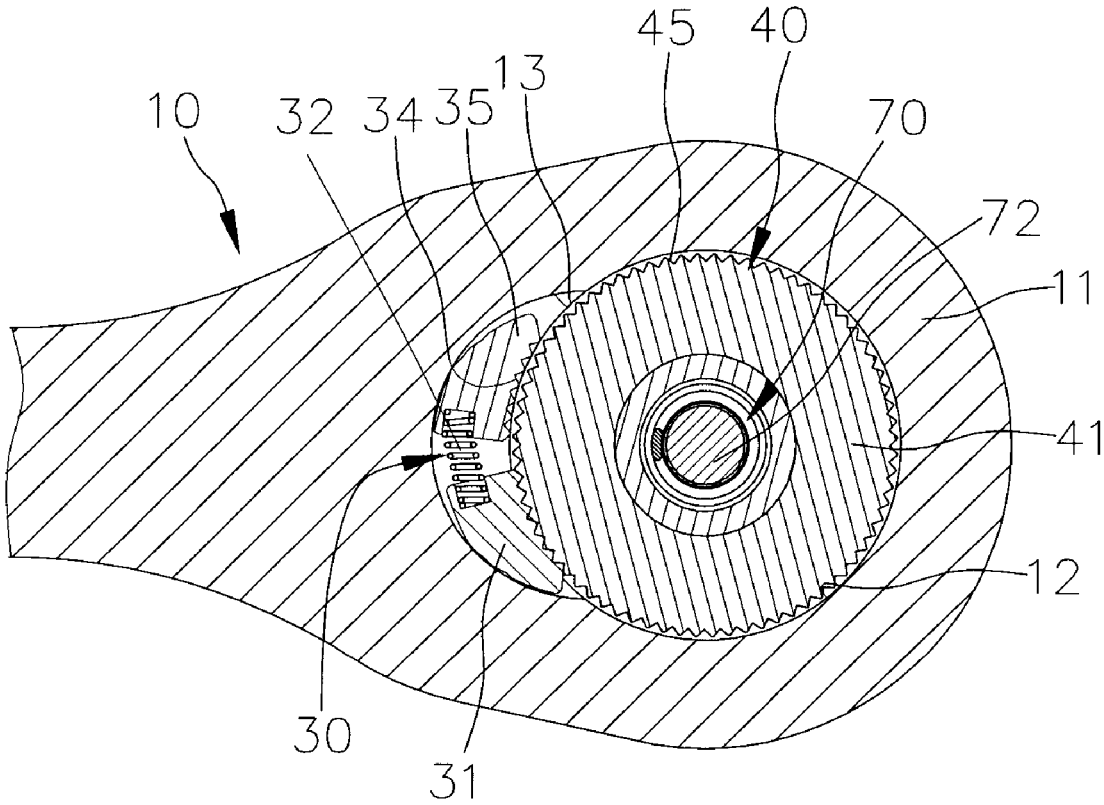
FIG. 5 is a cross-sectional view taken along a line 5—5 of FIG. 3.

Referring to FIGS. 3 to 5, the direction switch 50 is in a neutral position.

Although not shown, the direction switch 50 can be moved to a first position. The finger 24 pushes the rod 33. Thus, the pawl 35 is moved into a right-hand end of the crescent space 13. Thus, the annular head 11 can drive the joint 40 counterclockwise, but not vice versa.

On the contrary, the direction switch 50 can be moved to a second position. The finger 24 pushes the rod 37. Thus, the pawl 31 is moved into a left-hand end of the crescent space 13. Thus, the annular head 11 can drive the joint 40 clockwise, but not vice versa.

Figure 6:
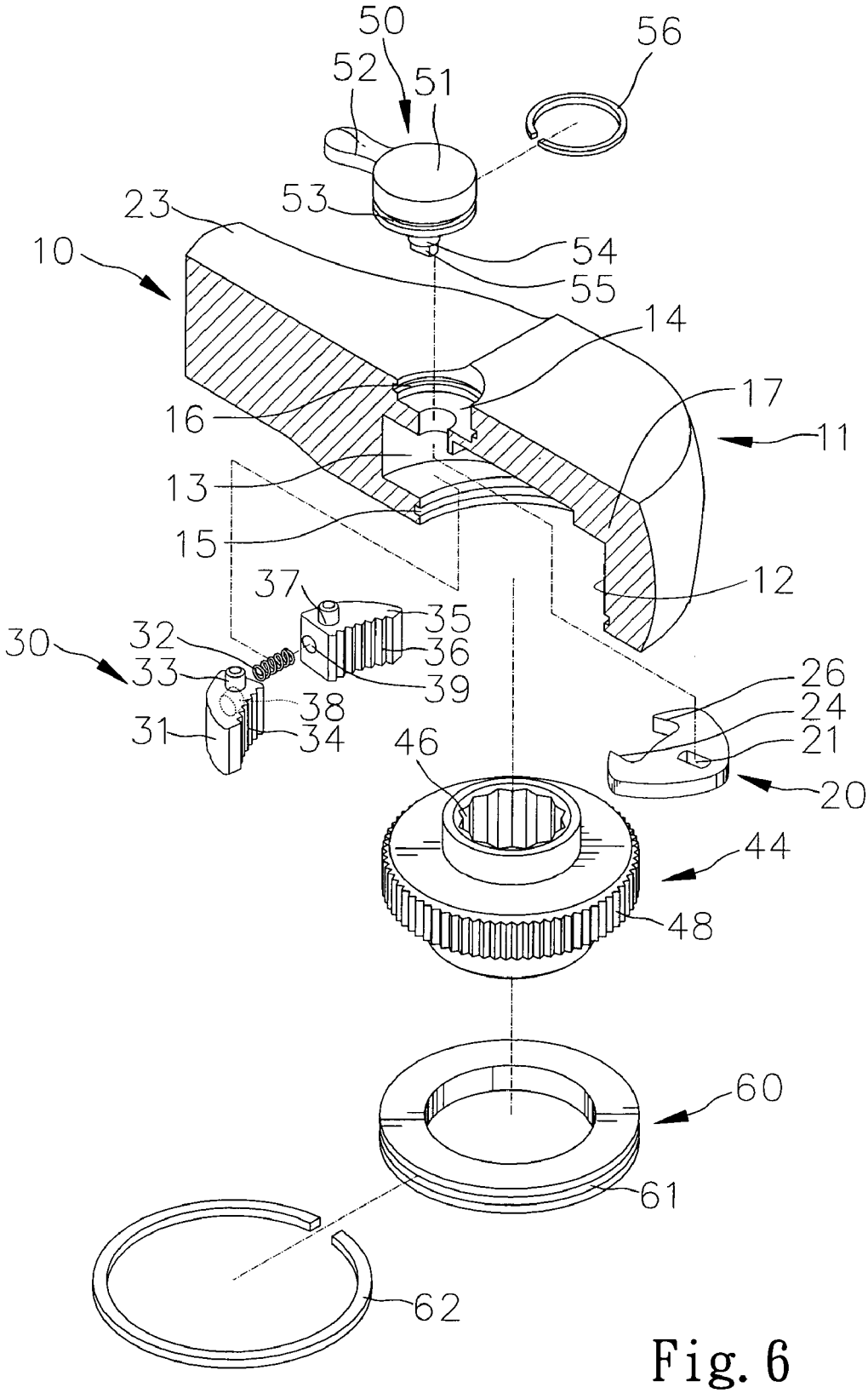
FIG. 6 is an exploded view of the selective one-way wrench according to a second embodiment of the present invention.
Figure 7:
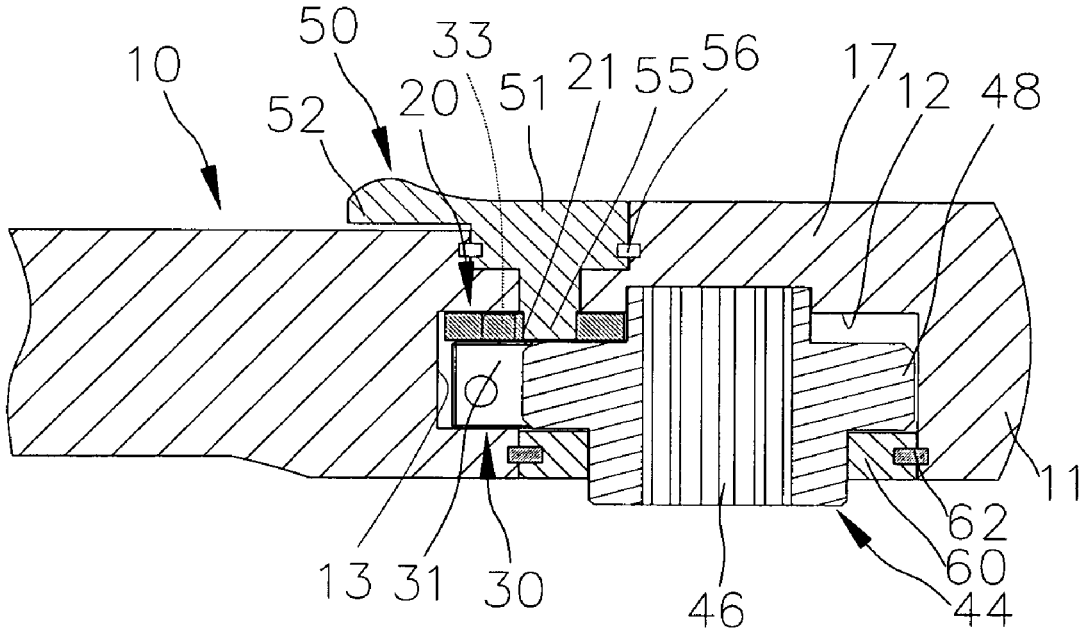
FIG. 7 is a cross-sectional view of the selective one-way wrench of FIG. 6.
Figure 8:
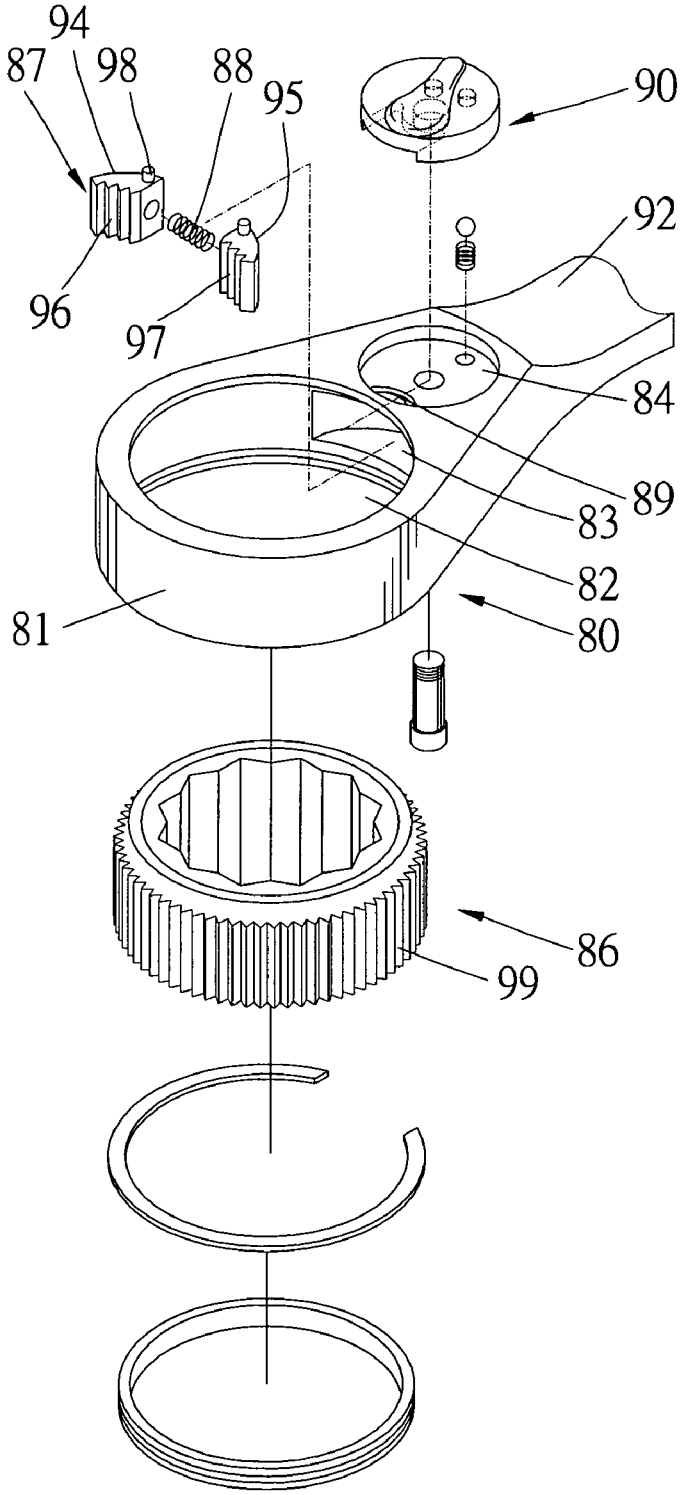
Fig. 8 PRIOR ART
FIG. 8 is an exploded view of a conventional selective one-way wrench.

FIGS. 6 and 7 show a selective one-way wrench according to a second embodiment of the present invention. The second embodiment is identical to the first embodiment except for replacing the joint 40 with the annular gear 44 and the control device 70 is deleted. The annular gear 44 includes a toothed internal face 46 for engagement with a bolt or nut.

The present invention has been described through detailed illustration of two embodiments. Those skilled in the art can derive variation from the embodiments without departing from the scope of the present invention. Therefore, the embodiments shall not limit the scope of the present invention defined in the claims.

What is claimed is:

1. A selective one-way wrench comprising:

a handle;

an annular head from which the handle projects, the annular head defines a first space and a second space communicated with the first space;

a gear rationally put in the first space, the gear including a toothead external face;

a direction controller put in the second space, the direction controller including two pawls and a spring installed between the pawls each including a rod formed thereon and a toothed face;

a driver put rationally in the second space, the driver including two fingers selective one of the which contacts the rod of selective one of the pawls so as to bring the toothead face of the selected pawl into engagement with the toothead external face of the gear; and a direction switch installed rotationally on the annular head and operably connected with the driver including a countersink hole communicated with the second space, and the direction switch is inserted into the second space through the countersink hole wherein the direction switch includes a disc and a shaft extending from the disc, and the driver is attached to the shaft.

2. The selective one-way wrench according to claim 1 wherein the direction switch further includes a ridge extending from the shaft, the driver defines a recess for receiving the ridge.

* * * * *